United States Patent [19]

Boetzkes

[11] Patent Number: 4,607,759

[45] Date of Patent: Aug. 26, 1986

[54] SEALING CAP HAVING FRANGIBLE MEANS

[76] Inventor: Klaus Boetzkes, Heiss-Str. 6, 8940 Memmingen, Fed. Rep. of Germany

[21] Appl. No.: 731,718

[22] Filed: May 8, 1985

[30] Foreign Application Priority Data

May 14, 1984 [DE] Fed. Rep. of Germany ..... 3417812

[51] Int. Cl.[4] ..... B65D 39/06; B65D 47/02; B65D 49/00

[52] U.S. Cl. ..... 220/266; 220/257; 215/251

[58] Field of Search ..... 220/265, 266, 284, 257, 220/270; 215/246, 251; 217/76, 98, 114

[56] References Cited

U.S. PATENT DOCUMENTS

| | | | |
|---|---|---|---|
| 3,952,901 | 4/1976 | Conti | 215/251 |
| 4,095,713 | 6/1978 | Norton | 220/257 |
| 4,165,018 | 8/1979 | Giggard | 220/257 |

*Primary Examiner*—George T. Hall
*Attorney, Agent, or Firm*—Holman & Stern

[57] ABSTRACT

A pilfer-proof sealing cap for use with keg barrels is arranged to fit over the disc on the barrel on which the tapping valve is mounted, and comprises a cover plate and a cylindrical skirt depending therefrom wherein the skirt includes inwardly sprung locking elements which engage under the disc. Inspection windows may be provided in order to check the condition of the locking elements which are arranged to break-off if the cap is removed or tampered with.

13 Claims, 8 Drawing Figures

SEALING CAP HAVING FRANGIBLE MEANS

BACKGROUND OF THE INVENTION

1. Field of the Invention

The invention relates to a sealing cap made of plastics material for valves in so-called Keg-barrels, comprising a cover plate and a cylindrical guideway which encircles the disc carrying the valve.

2. Description of the Prior Art

The so-called Keg-barrels are metal barrels of differing size which are for holding beer. These kegs are provided at the base thereof with a valve which can be connected to a tapping device. When the tapping device is put on, the valve is sealed and, moreover, a pressure is exerted on a sealing member of the valve so that the contents can be removed from the inside, or forced out by an internal carbon dioxide pressure, through a tube which extends to the opposite wall of the barrel, hereinafter referred to as a keg.

The valve projects by a small distance from the base in which it is mounted. The valve is protected by a circular flange provided on the keg.

An additional protection for the valve is needed when transporting these kegs. For this, cover caps made of plastics material are known which are matched to the flange of the valve so that they can be pressed on and held in place by a retaining bead. The contents of the keg can also be indicated with the aid of the locking cap. After the keg has been emptied the cover cap should be pressed on again in order to protect the seal until the keg is cleaned and refilled.

With kegs which have a closure of the kind described above, it is possible that on rare occasions the keg is not filled completely; for example after filling the valve may not be immediately sealed tightly or the filling was incomplete for other reasons, or leakages occur during transport. Furthermore, it is possible for the known closure to be opened—and this cannot be checked—and some of the contents removed. In the case of complaints therefore it is impossible to check and distinguish between kegs which have not been fully filled and/or had leakages during transport on the one hand and interference with the seal on the other.

BRIEF SUMMARY OF THE INVENTION

It is the object of the invention to provide a sealing cap for such kegs with valves of this type which will give secure protection during transportation and make unauthorized handling impossible.

The invention achieves this object through a sealing cap of the type described above and which provides that the sealing cap has locking elements which spring inwardly on the cylindrical guideway and grip under the disc on which the valve is mounted.

The plate which contains the valve is at a distance from the bottom of the keg. The locking elements on the cylindrical guideway sit between the bottom of the keg and the side of the plate facing towards the bottom of the keg. The locking elements are arranged in such a way that the sealing cap cannot be taken off without the locking elements being damaged, e.g. torn off, so that the locking elements show whether the sealing cap has been taken off or not.

A further object of the invention is to provide locking elements which are visible from the outside so that it can be seen immediately whether the locking elements have been damaged or broken off. Undamaged locking elements can, for example, be detected by touch.

In another embodiment of the invention, inspection windows for the locking elements are provided. These inspection windows, which are in the cylindrical guideway, enable one to see quickly whether there is any damage to the locking elements.

The inspection windows can either be located only in the cylindrical guideway or can extend into the cover plate of the sealing cap. If the inspection window extends as far as the cover plate of the sealing cap then any tampering is recognizable at a glance from above.

It has also been found to be advantageous if the inspection windows correspond largely to the dimensions of the locking elements. This simplifies the manufacture on the one hand and, on the other hand, any interference is made more difficult because there is no gap between the locking elements and the inspection windows into which a suitable tool could be inserted.

Moreover, this embodiment of the invention facilitates the placing of the sealing cap on to the valve. When it is pressed on the locking elements can spring back into the windows and not hinder the placing on of the cap. Once the sealing cap is pushed over the valve the locking elements spring back in again and grip under the plate of the valve.

It has also been found to be particularly beneficial if the locking elements are relatively numerous because this presents an additional protection against unsupervised opening. The uniform arrangement permits easy opening in the case of use in accordance with specifications.

It has further been found to be advantageous if the locking elements are connected to an underneath part of the cylindrical guideway via a thin fracture zone, e.g. perforations and if the fracture zone has different wall thicknesses. It has proved particularly beneficial if there is a somewhat thicker portion in an intermediate portion of the fracture zone, which portion is however thinner than the wall thickness of the sealing cap. When the sealing cap is first removed the locking elements do not break off completely but remain hanging, whereby the locking elements cannot fall off and impair the function of the valve.

In another embodiment of the invention part of the cylindrical guideway can be broken off and the break-off point can also be marked by a perforation. Breaking off this part facilitates correct handling of the sealing cap. The perforation is, for example, provided so that on breaking off the part, the locking elements remain on the broken-off part. This embodiment has the additional advantage that when the sealing cap is put on again, perhaps for return, the damaged locking elements cannot form any obstruction.

BRIEF DESCRIPTION OF THE DRAWINGS

Various embodiments of the sealing cap of the invention will now be described with reference to the accompanying drawing.

DETAILED DESCRIPTION

Figure 1:
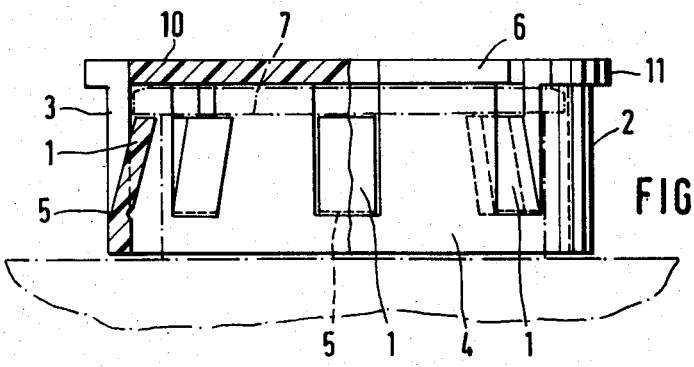
FIG. 1 is a side elevational view, partly in cross section, of a sealing cap according to the invention.
Figure 2:
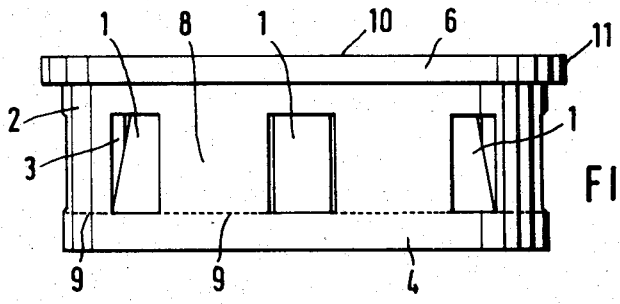
FIG. 2 is a view similar to FIG. 1 of another embodiment of a sealing cap according to the invention.
Figure 3:
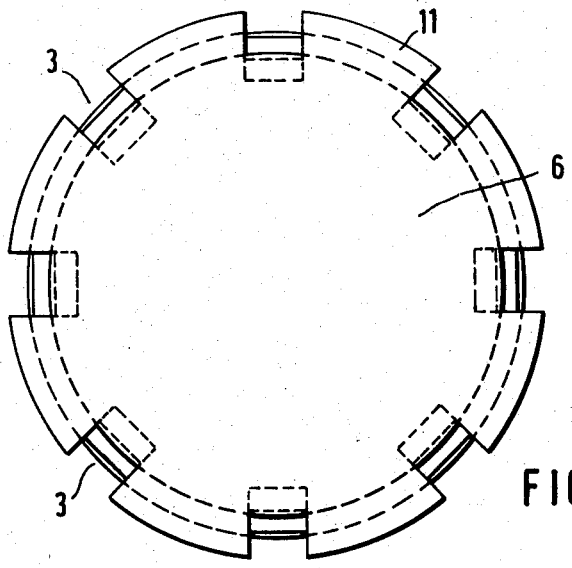
FIG. 3 is a top plan view of the cap illustrated in FIG. 1.

The sealing cap according to FIGS. 1–3 comprises basically a cover plate 6 and a cylindrical guideway 2. Inspection windows 3 are provided around the cylindrical guideway 2 at regular distances from one another. These inspection windows 3 may extend into the cover plate 6 as can be seen in FIG. 3. The locking elements 1 are seated in the inspection windows 3. The locking elements 1 are formed on the under part of the window 3 as shown in FIG. 1. It is beneficial if the sealing cap has as many locking elements 1 as possible.

During the manufacture as an injection molded part, the locking elements 1 on the sealing cap according to FIG. 1 are formed with the aid of one slide respectively which is pushed inwards through the inspection window 3. This method of manufacture requires relatively little expense.

It can be seen in FIG. 1 how the locking elements 1, through their inclined position, grip under the valve plate 7 shown with dot-dash lines. When the sealing cap is placed on the valve plate the locking elements 1 spring outwardly into the inspection windows and thus allow the cap to be placed on the valve plate.

Figure 4:
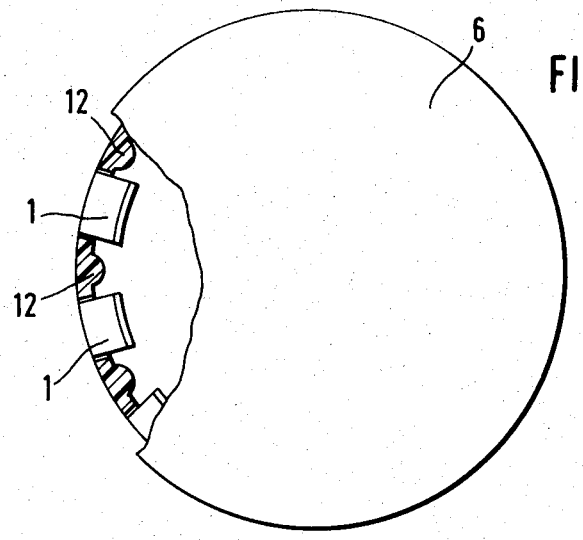
FIG. 4 is a top plan view, partly in cross section, showing a detail of a different embodiment of the invention.

An excessive deformation of the locking elements 1 when the cap is placed on the valve plate can be avoided through ribs 12, parallel to the axis of the cap, as shown in FIG. 4, so that the locking elements do not break off as soon as the sealing cap is put on.

Once the sealing cap is seated on the valve the locking elements move inwardly and grip under the valve plate 7. In this way the sealing cap is held on the valves on the one hand, and on the other hand, the valve plate 7 provides the locking elements 1 with the means for preventing them from becoming damaged, for instance from breaking off, when the cap is removed.

Figure 5:
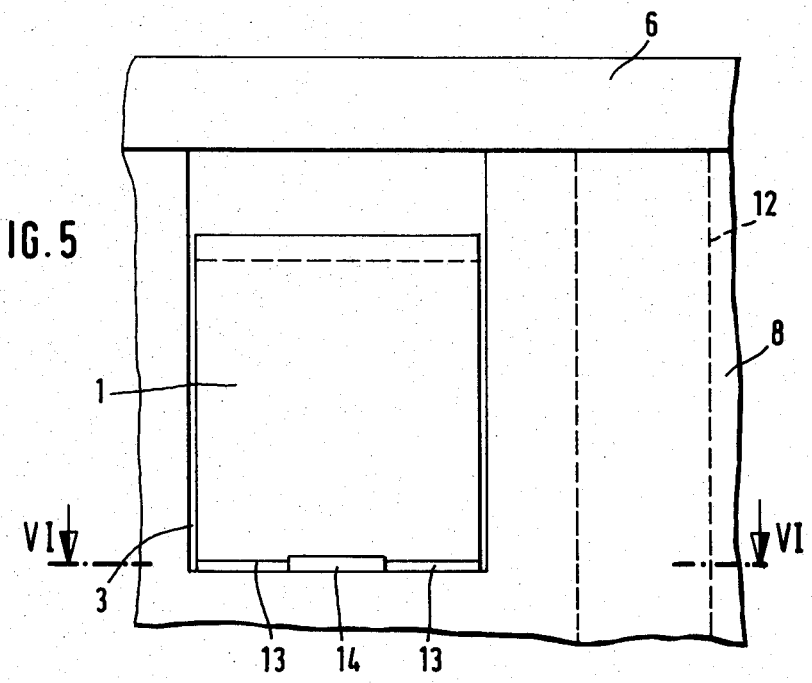
FIG. 5 is an enlarged, partial, side elevational view of the embodiment of FIG. 4.
Figure 6:
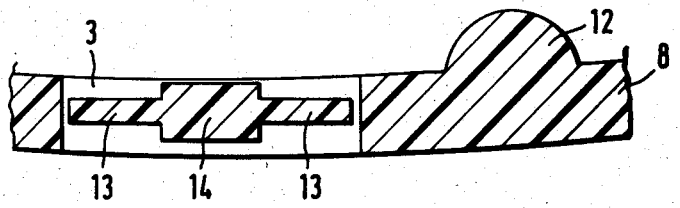
FIG. 6 is a cross sectional view taken on line VI—VI of FIG. 5.

If it is not required for the locking elements 1 to break and drop off completely at the first opening, the fracture zones 5 of the locking elements can have different wall thicknesses, as can be seen in FIGS. 5 and 6. When the locking elements 1 are snapped off the thick part 14 of the fracture point 5 breaks while the thin part 13 is sufficiently flexible to avoid breaking by bending.

The locking elements 1 can also have the shape of a bar, i.e., they can be of greater height compared with the width. This ensures that they will be damaged, namely snapped off, in the case of tampering.

In the embodiment shown in FIG. 1 the locking elements 1 are joined to the bottom part 4 of the cylindrical guideway by a thin fracture zone 5. This fracture zone 5 makes it easier for the locking elements to break off. The fracture zone 5 may alternatively be a perforation.

If the inspection window 3 also extends to the cover plate 6 of the sealing cap, as in the embodiment shown in FIGS. 1 and 3, it is easier to recognize damage to the locking elements.

Figure 7:
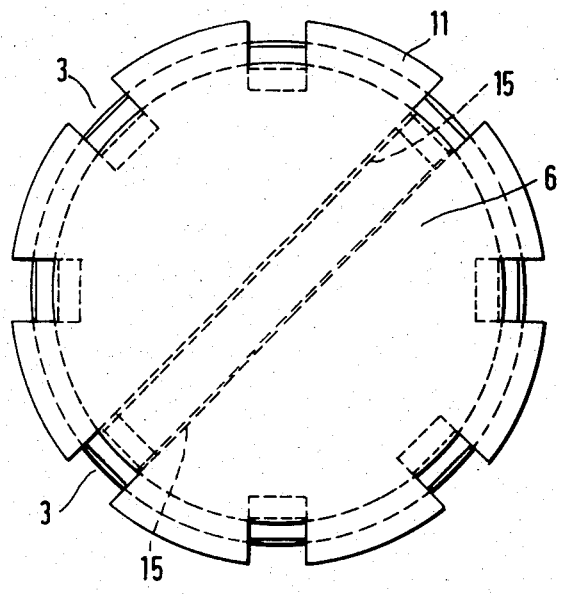
FIG. 7 is a top plan view of another embodiment of a sealing cap in accordance with the invention and FIG. 8 is a top plan view, partly in cross section, of a still further embodiment of the invention.

It is even simpler to recognize that the sealing cap has been opened if the cover plate has one or several rupture lines 15. In this embodiment, which is illustrated in FIG. 7, the cover plate 6 is divided, for opening, at the rupture line 15, which is for example designed as a perforation. Opening of the sealing cap is facilitated, while recognition of damage is made very much easier. A cover plate such as this is however, in general, no longer reusable then as a protective cap.

In the embodiment which is illustrated in FIG. 2 the locking elements 1 are connected to the bottom part 4 of the cylindrical guideway without a rupture point. Here, the perforation 9 is situated on the gap 8 between the windows at the same height as the bottom edge of the inspection windows 3. After this perforation 9 has been separated through the bottom part 4 can be removed with the locking elements 1. The rest of the sealing cap is lifted up in a simple manner for the keg to be emptied and is put back on again for the return journey.

The top surface 10 of the cover plate 6 can be used for indicating the contents of the keg. The collar or flange 11 facilitates handling the sealing cap.

Figure 8:
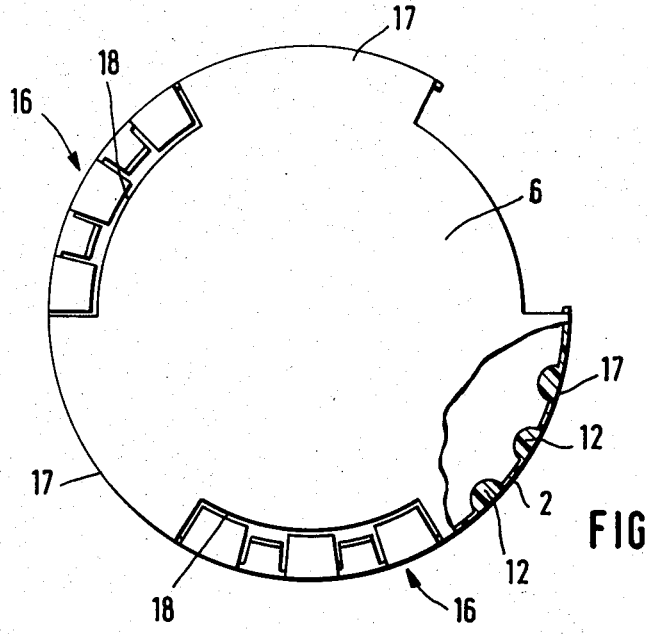

Another embodiment of the invention is illustrated in FIG. 8. On the circumference of the cylindrical guideway 2 several sections 16 are provided which extend partially into the cover plate 6 and are readily breakable. In the embodiment shown three such sections are provided, one of which has been broken off. Between these sections 16, sections 17 are provided which are firmly joined to the cover plate 6 and only have ribs 12, similar to those shown in FIG. 4.

The sections 16 are divided from the cover plate 6 by separating cuts 18 and are provided in each case with the inspection windows 3 and the locking elements 1.

The sealing cap in accordance with the embodiment shown in FIG. 8 is pressed on to the valve plate 7 in the same way as in the other embodiments. The locking elements 1 of the section 16 hold the sealing cap firm.

If the sealing cap is to be removed, the sections 16 are broken off; this is made easier by the dividing cut 18 so that the material only has to be broken through in the region of the cylindrical guideway.

Since the locking elements 1 are also removed in the breaking off process, the remaining cover can easily be removed from the valve plate 7 with the sections 17 and also being able to be put back on again so that the protective function of the sealing cap is maintained. The broken-off sections 16 do however show clearly that the sealing cap has been removed.

In the removal of the sealing cap as shown in FIG. 8 without breaking off the sections 16, the locking elements 1 are broken off or deformed, as is described in the other embodiments.

It is recommended to provide three sections 16 and three sections 17, whereby the sections 16 and 17 extend approximately over an equal-sized area.

The sealing caps as described by the invention have, in general, a very thin wall thickness which is less than indicated in the drawings. As a rule, wall thicknesses of about one millimeter or a little less are adequate.

I claim:

1. A sealing cap made from plastic material for use on valves in keg-barrels wherein a disc is provided for mounting a valve on a barrel, comprising:

a cover plate;

a cylindrical guideway depending from said cover plate;

a plurality of locking elements on said cylindrical guideway biased inwardly of said guideway for gripping engagement under said disc; and a thin fracture zone adjacent an underneath part of said cylindrical guideway connecting each locking element to said cylindrical guideway.

2. A cap as claimed in claim 1 wherein means are provided on said cap to allow said locking elements to be visible from the exterior of the cap.

3. A cap as claimed in claim 2 wherein said means to allow visibility of said locking elements comprises inspection windows for inspecting the locking elements.

4. A cap as claimed in claim 3 wherein said inspection windows are arranged in said cylindrical guideway.

5. A cap as claimed in claim 1, wherein guide ribs extending parallel to the axis of said cylindrical guideway are provided on the interior of said cylindrical guideway.

6. A cap as claimed in claim 1 wherein each fracture zone has varying wall thicknesses.

7. A cap as claimed in claim 1 wherein at least one rupture line is provided in said cover plate extending across the entire width of said cover plate.

8. A sealing cap made from plastic material for use on valves in keg-barrels wherein a disc is provided for mounting a valve on a barrel, comprising:

a cover plate;

a cylindrical guideway depending from said cover plate;

a plurality of locking elements on said cylindrical guideway biased inwardly of said guideway for gripping engagement under said disc; and a plurality of rupture lines spaced around the circumference of said cylindrical guideway to provide a break off section on said cylindrical guideway, said locking elements being connected to said break off section.

9. A cap as claimed in claim 8 wherein said rupture lines extend between said locking elements.

10. A cap as claimed in claim 8 wherein means are provided on said cap to allow said locking elements to be visible from the exterior of the cap.

11. A cap as claimed in claim 10 wherein said means to allow visibility of said locking elements comprises inspection windows for inspecting the locking elements.

12. A cap as claimed in claim 11 wherein said inspection windows are arranged in said cylindrical guideway.

13. A cap as claimed in claim 8, wherein guide ribs extending parallel to the axis of said cylindrical guideway are provided on the interior of said cylindrical guideway.

* * * * *